United States Patent [19]

Horodysky et al.

[11] 4,298,484

[45] Nov. 3, 1981

[54] NITROGEN-CONTAINING PRODUCTS OF PHOSPHOSULFURIZED ESTERS AND LUBRICANTS CONTAINING SAME

[75] Inventors: Andrew G. Horodysky, Cherry Hill; Joan M. Kaminski, Clementon, both of N.J.

[73] Assignee: Mobil Oil Corporation, New York, N.Y.

[21] Appl. No.: 141,823

[22] Filed: Apr. 21, 1980

[51] Int. Cl.[3] ..... C10M 1/48

[52] U.S. Cl. ..... 252/46.7; 260/125

[58] Field of Search ..... 252/46.7; 260/125, 927 R

[56] References Cited

U.S. PATENT DOCUMENTS

| | | | |
|---|---|---|---|
| 2,809,935 | 10/1957 | Chapman et al. | 252/46.7 |
| 3,043,773 | 7/1962 | Cortiss et al. | 252/46.7 |
| 3,159,664 | 12/1964 | Bartlett | 252/46.7 X |
| 3,184,411 | 5/1965 | Lowe | 252/46.7 |
| 3,192,162 | 6/1965 | Bartlett et al. | 252/46.7 X |
| 3,196,110 | 7/1965 | O'Halloran | 252/46.7 |
| 3,513,093 | 5/1970 | LeSuer | 252/46.7 X |
| 3,950,341 | 4/1976 | Okamoto | 252/46.7 X |
| 4,028,258 | 6/1977 | Kablaoui et al. | 252/46.7 |

*Primary Examiner*—Andrew Metz

*Attorney, Agent, or Firm*—Charles A. Huggett; Michael G. Gilman; Claude E. Setliff

[57] ABSTRACT

The invention herein is concerned with novel compositions of matter made by (1) reacting phosphorus pentasulfide with a polyhydroxyester and (2) reacting this product with a nitrogen-containing compound, and lubricant compositions containing same.

20 Claims, No Drawings

NITROGEN-CONTAINING PRODUCTS OF PHOSPHOSULFURIZED ESTERS AND LUBRICANTS CONTAINING SAME

BACKGROUND OF THE INVENTION

1. Field of the Invention

The invention is concerned with a novel group of compounds and their use as friction reducing and antiwear additives in lubricants, i.e. lubricant compositions containing same.

2. Discussion of the Prior Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present therein.

Friction is also a problem any time two surfaces are in sliding or rubbing contact. It is of especial significance in an internal combustion engine, because loss of a substantial amount of the theoretical mileage possible from a gallon of fuel is traceable directly to friction.

Phosphorus compounds are known to be useful as additives to lubricants to improve some property thereof, e.g. the antiwear property. Further, lubricants containing metal salts of phosphorus acids are also known. However, no prior art is known disclosing or suggesting the reaction product of the present invention.

SUMMARY OF THE INVENTION

In accordance with this invention, there are provided compounds prepared by (1) reacting a phosphorus polysulfide with a monoester, a diester or a mixture of esters of the formulae

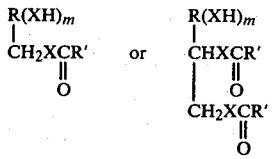

wherein m is from 1 to 4, X is oxygen or sulfur and R and R' are hydrocarbyl groups having from 1 to 23 carbon atoms, where R is preferably an alkyl group having 1 to 4 carbon atoms and preferably R' is an alkyl group having 9 to 23 carbon atoms and (2) reacting the product of (1) with an amine or diamine. It will be understood that the XH groups in the ester may be found at any place along the R chain. It will be further understood that all X's can be oxygens, all can be sulfur or X can be oxygen at one point and sulfur in another within the same molecule.

The invention also provides a lubricant composition comprising lubricant and the said reaction product.

DESCRIPTION OF SPECIFIC EMBODIMENTS

The novel compounds of this invention are made by (1) reacting phosphorus polysulfide, such as phosphorus pentasulfide, with a monoester or diester having the formulaset forth hereinabove and (2) reacting the resulting product with a nitrogen-containing compound. The product of the first reaction is a complex one and its structure is not known, although it may contain one or more of the following structures, illustrated with a glycerol monocarboxylate.

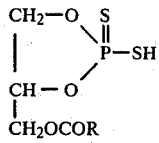

I.

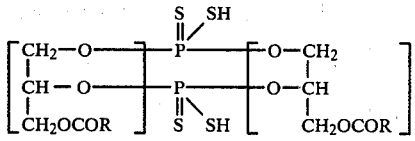

II.

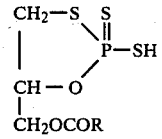

III.

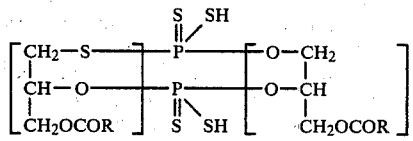

IV.

These 4 structures would require 2 moles of the glycol and 1 mole of $P_2S_5$.

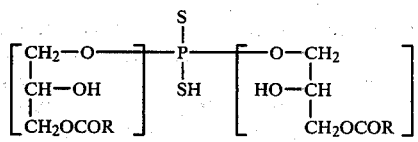

V.

or

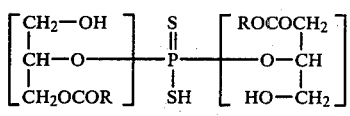

VI.

These structures V and VI would require 4 moles of glycol per mole of $P_2S_5$. However, the amount of reactants in reaction(1) is not limited to the stated ratios. It is contemplated that in that reaction, from about 12 moles to about 2 moles of polyhydroxyester, preferably from about 4 moles to about 2 moles, can be used per mole of $P_2S_5$. The temperature of this reaction can be within the range of from about 60° C. to about 140° C., preferably from about 90° C. to about 110° C.

Reaction (2) can be carried out at from about 50° C. to about 125° C., preferably from about 70° C. to about 100° C. Stoichiometric amounts of reagents may be used, or, if desired, a slight excess of about 1 to 5%. By "stoichiometric amounts" is meant sufficient amount of the nitrogen-containing compound to supply the required amount thereof to react with all the acid groups present in the complex product.

The nitrogen-containing compound can be any of a variety of compounds, including amines. These include the primary, secondary and tertiary aliphatic amines, where aliphatic is preferably an alkyl or alkylene group containing from about 8 to 30 carbon atoms. Among these are amines such as cocamine, oleylamine, tallowamine and the like. Also included are the diamines of the formula R NH $(CH_2)_hNH_2$, wherein R is hydrogen or an alkyl group containing 1 to 30 carbon atoms and n is from 3 to 6. An example of this type is N-oleyl-1,3-propylenediamine.

Further, aromatic amines of the formula R—Ar—$NH_2$ are meant to be embraced. In this formula R is alkyl of from 1 to 20 carbon atoms and Ar is an aromatic nucleus containing 6 to 14 carbon atoms. Illustrated is octylphenylnaphthylamine. As one other example of the useful amines, the polyalkylenepolyamines are mentioned.

These have the formula $$R\ NH\ (R'NH)_m—H$$

wherein R is hydrogen or a hydrocarbyl group containing1 to 20 carbon atoms, R' is an alkylene group having 1 to 5 carbon atoms, and m is an integer of 1 to 10, inclusive.

While atmospheric pressure is generally preferred, either reaction can be advantageously run at from about 0.5 to about 2.0 atmospheres. Furthermore, where conditions warrant it, a solvent may be used. In general, reaction (1) can be run in the absence of solvent or in non-polar, unreactive solvent including benzene, toluene, xylene or 1,4-dioxane. Reaction (2) can be run in the absence of solvent or in any alcoholic solvent including isopropanol and n-butanol or in a mixture of polar and non-polar solvents, such as toluene and isopropanol. The times of reactions for the reactions are not critical. Thus, any phase of the process can be carried out in from 1 to 8 hours.

Most of the polyhydroxyesters are commercially available as mixtures of the mono- and diesters. While these may be used where the monoester is the predominant form, the pure monoester can be prepared by known methods. For example, the glycerol monooleate of the Examples can be prepared pure as follows:

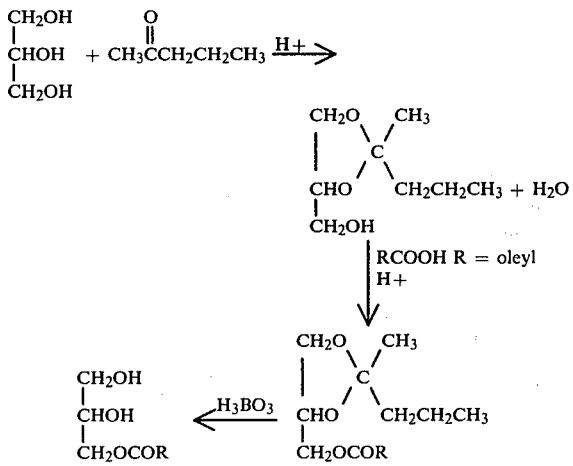

The thioglycerol monooleate is prepared similarly.

Of particular significance, in accordance with the present invention, is the ability to improve the friction properties of oleaginous materials such as lubricating media which may comprise either a mineral oil or a synthetic oil, or a grease therefrom. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F., and preferably, from about 50 to about 250 SSU at 210° F. These oils may have viscosity indexes ranging to about 100 or higher. Viscosity indexes from about 70 to about 95 are preferred. The average molecular weights of these oils may range from about 250 to about 800.

In instances where synthetic oils are desired in preferance to mineral oils, or in combination therewith, various compounds of this type may be successfully utilized. Typical synthetic vehicles include polyisobutylene, polybutenes, hydrogenated polyolefins, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenol) ether, phenoxy phenylethers.

It is to be understood, however, that the compositions contemplated herein can also contain other matrials. For example, corrosion inhibitors, extreme pressure agents, viscosity index improvers, co-antioxidants, antiwear agents and the like can be used. These materials do not detract from the value of the compositions of this invention, but rather they serve to impart their customary properties to the particular compositions in which they are incorporated.

In general, the performed adducts of the present invention may be employed in any amount which is effective for imparting the desired degree of friction reduction or antiwear activity. In many applications, however, the adduct is effectively employed in amounts from about 0.1% to about 10% by weight, and preferably from about 0.5 to about 5% of the total weight of the composition.

The following Examples will present illustrations of the invention. They are illustrative only, and are not meant to limit the invention.

EXAMPLE 1

Glycerol Monooleate

Obtained commercially as a 60:40 mixture of mono and dioleates, respectively.

EXAMPLE 2

Partially phosphosulfurized glycerol monooleate(GMO) (4 moles GMO:1 mole $P_2S_5$)

Approximately 511 g of glycerol monooleate was heated to 100° to 110° C. and 61 g of phosphorus pentasulfide was added batchwise over a one hour period. The reaction mixture was heated an additional 3 hours at this temperature, at which time hydrogen sulfide no longer evolved. The reaction mixture was filtered through diatomaceous earth to yield a slightly viscous orange fluid.

EXAMPLE 3

Phosphosulfurized glycerol monooleate(GMO) (1 mole GMO:1 mole $P_2S_5$)

Approximately 1508 g of glycerol monooleate was heated to 90°–100° C. and 371 g of phosphorus pentasulfide was added batchwise over a one hour period. The reaction mixture was heated an additional 4 hours at this temperature, at which time hydrogen sulfide no longer evolved. The reaction mixture was filtered through diatomaceous earth to yield a slightly viscous orange liquid.

EXAMPLE 4

Oleyl amine salt of partially phosphosulfurized glycerol monooleate

Approximately 41.1 g of partially phosphosulfurized glycerol monooleate, prepared as described in Example 2, and 16.2 g of oleyl amine were refluxed in 150 cc of isopropanol solvent for 2½ hours. The solvent was removed by vacuum distillation leaving a pale yellow waxy solid.

EXAMPLE 5

Oleyl amine salt of phosphosulfurized glycerol monooleate

Approximately 50 g of phosphosulfurized glycerol monooleate, prepared as described in Example 3, and 28.6 g of oleyl amine were refluxed in 100 cc of isopropanol solvent for 1½ hours. The solvent was removed by vacuum distillation leaving a pale yellow, waxy solid.

EXAMPLE 6

N-oleyl-1,3-propylenediamine salt of partially phosphosulfurized glycerol monooleate Approximately 92.2 g of partially phosphosulfurized glycerol monooleate, prepared as described in Example 2, and 18.3 g of N-oleyl-1,3-propylenediamine were refluxed in 100 cc isopropanol solvent for 2 hours. The solvent was removed by vacuum distillation leaving a golden colored, viscous, waxy oil.

EXAMPLE 7

N-oleyl-1,3-propylenediamine salt of phosphosulfurized glycerol monooleate

Approximately 48 g of phosphosulfurized glycerol monooleate, prepared as described in Example 3, and 16.1 g of N-oleyl-1,3-propylenediamine were refluxed in 200 cc of isopropanol and 50 cc of toluene solvents for 5 hours. Solvents were removed by vacuum distillation yielding an orange-brown, viscous liquid.

EXAMPLE 8

Monothioglycerol monooleate

Approximately 70.5 g of 1-thioglycerol, 277 g of 2-pentanone, and 2 g of p-toluene sulfonic acid were refluxed until the expected 20 cc of water was removed by azeotropic distillation. Approximately 163 g of oleic acid was added to the reaction solution and it was refluxed until the expected 10 cc of water azeotroped off. The reaction solution was cooled, transferred to a 2 liter separatory funnel, and diluted with 800 cc of toluene. The reaction solution was shaken with 6 g of sodium acetate washed with water (4×400 cc), and dried over sodium sulfate. The reaction solution was filterd, and solvents were removed by vacuum distillation. Approximately 190 g of the resulting yellow liquid was refluxed in 520 cc of monomethylethyleneglycol solvent, with 103 g of boric acid, at 100° C. for 2 hours. The reaction solution was transferred to a 2 liter separatory funnel, diluted with 875 cc of ethyl ether, washed with water (4×750 cc), washed with 13% sodium bicarbonate solution (2×100 cc), and washed with water (2×100) again. The ether solution was shaken with 14 g of sodium acetate and 100cc of water, washed with a saturated sodium chloride solution (3×150 cc), and dried over magnesium sulfate. Solvents were removed by distillation and the resulting product was filtered through diatomaceous earth to yield a clear, bright yellow liquid. Gel permeation chromatography of the product showed that it was free of oleic acid and contained approximately 80% monothioglycerol monooleate and 20% monothioglycerol dioleate.

EXAMPLE 9

Partially phosphosulfurized monothioglycerol monooleate (MTGMO) (4 moles MTGMO: 1 mole $P_2S_5$)

Approximately 140 g of monothioglycerol monooleate, prepared as described in Example 8, was heated to 90°-110° C. and 21 g of phosphorus pentasulfide was added batchwise over a period of one hour. The reaction mixture was heated an additional 4 hours at 100° C., at which time hydrogen sulfide no longer evolved. The reaction mixture was filtered through diatomaceous earth, yielding a slightly viscous, orange liquid.

EXAMPLE 10

N-oleyl-1,3-propylenediamine salt of partially phosphosulfurized monothioglycerol monooleate Approximately 34 g of partially phosphosulfurized monothioglycerol monooleate, prepared as described in Example 9, and 18 g of N-oleyl-1,3-propylenediamine were refluxed in 100 cc of isopropanol solvent for 2 hours. The solvent was removed by vacuum distillation leaving an orange-brown, viscous oil.

EVALUATION OF THE COMPOUNDS

The compounds were evaluated in a low velocity friction apparatus (LVFA) in a fully formulated 5W-20 oil containing 20% by weight of an additive package including antioxidant, dispersant and detergent. The friction reducing compound was 1-5% of the total weight of oil. Base oil had the following general characteristics:

Kinematic Viscosity:
@ 100° C.-6.8 cs
@ 40° C. -36.9 cs
Viscosity Index: 143.

DESCRIPTION

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

Procedure

The rubbing surfaces and 12–13 ml. of test lubricants are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 min. at 250° F., 240 psi, and 40 fpm sliding speed. Afterward, measurements of $U_k$ vs. speed were taken at 240, 300, 400, and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psi.

TABLE 1

| Compn. Tested | Wt. % Additive | Sliding Speed 5 ft./min. | Sliding Speed 30 ft./min. |
|---|---|---|---|
| Base Oil | 0 | 0[a] | 0[a] |
| Oil + Ex. 4 | 4 | 39 | 35 |
| Oil + Ex. 5 | 4 | 33 | 26 |
| | 2 | 16 | 12 |
| Oil + Ex. 6 | 4 | 15 | 15 |
| Oil + Ex. 7 | 4 | 31 | 26 |
| Oil + Ex. 10 | 2 | 21 | 18 |

[a]Value for base fluid assigned as zero point.

The products were also evaluated for oxidation stability. In most cases improvements in oxidative stability over the base oil were observed. Basically the test lubricant is subjected to a stream of air which is bubbled through at the rate of 5 liters per hour at 425° F. for 24 hours. Present in the composition are samples of metals commonly used in engine construction, namely iron, copper, aluminum and lead. See U.S. Pat. No. 3,682,980, incorporated herein by reference for further details of the test. Improvement in Viscosity index or neutralization number (or both) show effective control. See the results in Table 2.

TABLE 2

| Examples | Conc. | % Increase in Viscosity of Used oil vs. New Oil @ KV 100° Co. | Acid No. | Pb loss (mg) |
|---|---|---|---|---|
| Base Oil 200" Solvent Paraffinic Neutral Mineral Oil | | 19 | 2.55 | 0.0 |
| 5 | 1 | 8 | 0.91 | 0.6 |
| | 3 | 4 | 1.03 | 0.8 |
| 6 | 1 | 39 | 1.96 | 0.0 |
| | 3 | 40 | 2.51 | 0.7 |
| 7 | 1 | 9 | 1.14 | 0.3 |
| | 3 | 5 | 1.69 | 0.0 |

We claim:

1. A compound prepared by (1) reacting an ester or mixtures thereof of the formula

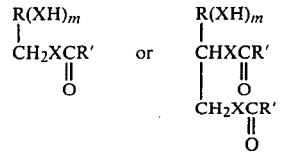

wherein m is from 1 to 4, X is oxygen or sulfur, R and R′ are hydrocarbyl groups having from 1 to 23 carbon atoms with a phosphorus polysulfide, wherein about 2 to about 12 moles of ester are reacted per mole of polysulfide and wherein the temperature of reaction is from about 60° C. to about 140° C., and then (2) reacting the product from (1) with at least a stoichiometric amount of an amine, the reaction temperature of this step being from about 50° C. to about 125° C.

2. The compound of claim 1 wherein the polysulfide is pentasulfide.

3. The compound of claim 1 wherein the amine is oleylamine.

4. The compound of claim 1 wherein the amine is N-oleyl-1,3-propylenediamine.

5. The compound of claim 1 wherein the ester is glycerol oleate.

6. The compound of claim 5 wherein the ester contains about 60% by weight of glycerol monooleate and about 40% by weight of glycerol dioleate.

7. The compound of claim 1 wherein the ester is comprised of about 60% by weight of glycerol monooleate and about 40% by weight of glycerol diooleate, the polysulfide is pentasulfide and the amine is oleylamine.

8. The compound of claim 1 wherein the ester is comprised of about 60% by weight of glycerol monooleate and about 40% by weight of glycerol dioleate, the polysulfide is pentasulfide and the amine is N-oleyl-1,3-propylenediamine.

9. The compound of claim 1 wherein the ester is thioglycerol oleate.

10. The compound of claim 1 wherein the ester is comprised of about 80% by weight of thioglycerol monooleate and about 20% by weight of thioglycerol diooleate, the polysulfide is pentasulfide and the amine is N-oleyl-1,3-propylenediamine.

11. A lubricant composition comprising a major proportion of a mineral or synthetic lubricanting oil or a grease therefrom and a friction reducing amount of the compound of claim 1.

12. The composition of claim 11 wherein in preparing said compound, said polysulfide is pentasulfide.

13. The composition of claim 11 wherein the amine is oleylamine.

14. The composition of claim 11 wherein the amine is N-oleyl-1,3propylenediamine.

15. The composition of claim 11 wherein in preparing said compound the ester is glycerol oleate.

16. The composition of claim 15 wherein the ester contains about 60% by weight of glycerol monooleate and about 40% by weight of glycerol dioleate.

17. The composition of claim 11 wherein in preparing said compound the ester is comprised of about 60% by weight of glycerol monooleate and about 40% by weight of glycerol diooleate, the polysulfide is pentasulfide and the amine is oleylamine.

18. The composition of claim 11 wherein in preparing said compound the ester is comprised of about 60% by weight of glycerol monooleate and about 40% by weight of glycerol dioleate, the polysulfide is pentasulfide and the amine is N-oleyl-1,3-propylenediamine.

19. The composition of claim 11 wherein in preparing said compound the ester is thioglycerol oleate.

20. The composition of claim 11 wherein in preparing said compound the ester is comprised of about 80% by weight of thioglycerol monooleate and about 20% by weight of thioglycerol diooleate, the polysulfide is pentasulfide and the amine is N-oleyl-1,3-propylenediamine.

* * * * *